US008641185B2

(12) United States Patent
Igarashi

(10) Patent No.: US 8,641,185 B2
(45) Date of Patent: Feb. 4, 2014

(54) PRINTING DEVICE AND PRINTING METHOD

(75) Inventor: Hitoshi Igarashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 127 days.

(21) Appl. No.: 13/277,729

(22) Filed: Oct. 20, 2011

(65) Prior Publication Data

US 2012/0098913 A1 Apr. 26, 2012

(30) Foreign Application Priority Data

Oct. 21, 2010 (JP) ..... 2010-236624

(51) Int. Cl.
*B41J 2/01* (2006.01)

(52) U.S. Cl.
USPC ..... 347/104

(58) Field of Classification Search
None
See application file for complete search history.

(56) References Cited

U.S. PATENT DOCUMENTS

| | | | | |
|---|---|---|---|---|
| 5,580,042 | A * | 12/1996 | Taniguro et al. | 271/274 |
| 7,365,865 | B2 * | 4/2008 | Kidani et al. | 358/1.13 |
| 2002/0021929 | A1 | 2/2002 | Yamagishi et al. | |
| 2009/0189343 | A1 | 7/2009 | Hsu et al. | |

FOREIGN PATENT DOCUMENTS

| | | | |
|---|---|---|---|
| JP | 2002-302314 | A | 10/2002 |
| JP | 2004-122625 | A | 4/2004 |
| JP | 2007-119081 | A | 5/2007 |
| JP | 2009-173441 | A | 8/2009 |

* cited by examiner

*Primary Examiner* — Laura Martin
*Assistant Examiner* — Alexander C Witkowski
(74) *Attorney, Agent, or Firm* — Global IP Counselors, LLP

(57) ABSTRACT

To prevent conveyance defects due to kicking, a printing device includes a conveyance roller for conveying a medium in a conveyance direction; a guide for supporting the medium on a top surface of the guide on an upstream side in the conveyance direction from the conveyance roller; and a head for ejecting ink and printing on the medium on a downstream side in the conveyance direction from the conveyance roller; wherein the top surface of the guide is positioned higher than a line tangent to the conveyance roller at a position of contact between the conveyance roller and the medium; and an end part of the guide on the downstream side in the conveyance direction has a smaller thickness in the direction in which the medium is supported than on the upstream side of the end part in the conveyance direction.

11 Claims, 7 Drawing Sheets

PRINTING DEVICE AND PRINTING METHOD

CROSS-REFERENCE TO RELATED APPLICATIONS

This application claims priority to Japanese Patent Application No. 2010-236624 filed on Oct. 21, 2010. The entire disclosure of Japanese Patent Application No. 2010-236624 is hereby incorporated herein by reference.

BACKGROUND

1. Technological Field

The present invention relates to a printing device and to a printing method.

2. Background Technology

A printing device is known which is provided with a conveyance roller for conveying a medium in a conveyance direction, and a head for printing on the medium, the head being provided downstream in the conveyance direction from the conveyance roller. In such a printing device, a guide is sometimes provided for supporting the medium upstream in the conveyance direction from the conveyance roller (see Patent Citation 1, for example).

Japanese Patent Application Publication No. 2004-122625 (Patent Citation 1) is an example of the related art.

SUMMARY

Problems to be Solved by the Invention

In such a printing device, there is a risk of a conveyance defect referred to as "kicking" when the medium leaves the guide in a case in which the conveyance surface of the guide is at a high position. Kicking is a phenomenon in which a pushing force between the guide and the medium acts to push the medium out in the conveyance direction at the moment the trailing end (upstream end in the conveyance direction) of the medium leaves the guide. This kicking causes a conveyance error which can reduce the printing quality. Therefore, an advantage of the invention is to prevent conveyance defects due to kicking.

Means Used to Solve the Above-Mentioned Problems

The main invention for achieving the abovementioned advantage is a printing device including a conveyance roller for conveying a medium in a conveyance direction; a guide for supporting the medium on a top surface of the guide on an upstream side in the conveyance direction from the conveyance roller; and a head for ejecting ink and printing on the medium on a downstream side in the conveyance direction from the conveyance roller; the printing device being the top surface of the guide is positioned higher than a line tangent to the conveyance roller at a position of contact between the conveyance roller and the medium; and an end part of the guide on the downstream side in the conveyance direction has a smaller thickness in the direction in which the medium is supported than on the upstream side of the end part in the conveyance direction. Other characteristics of the present invention will become clearer from the description of the present specification and the accompanying drawings.

BRIEF DESCRIPTION OF THE DRAWINGS

Referring now to the attached drawings which form a part of this original disclosure.

DETAILED DESCRIPTION OF EXEMPLARY EMBODIMENTS

Figure 1A:
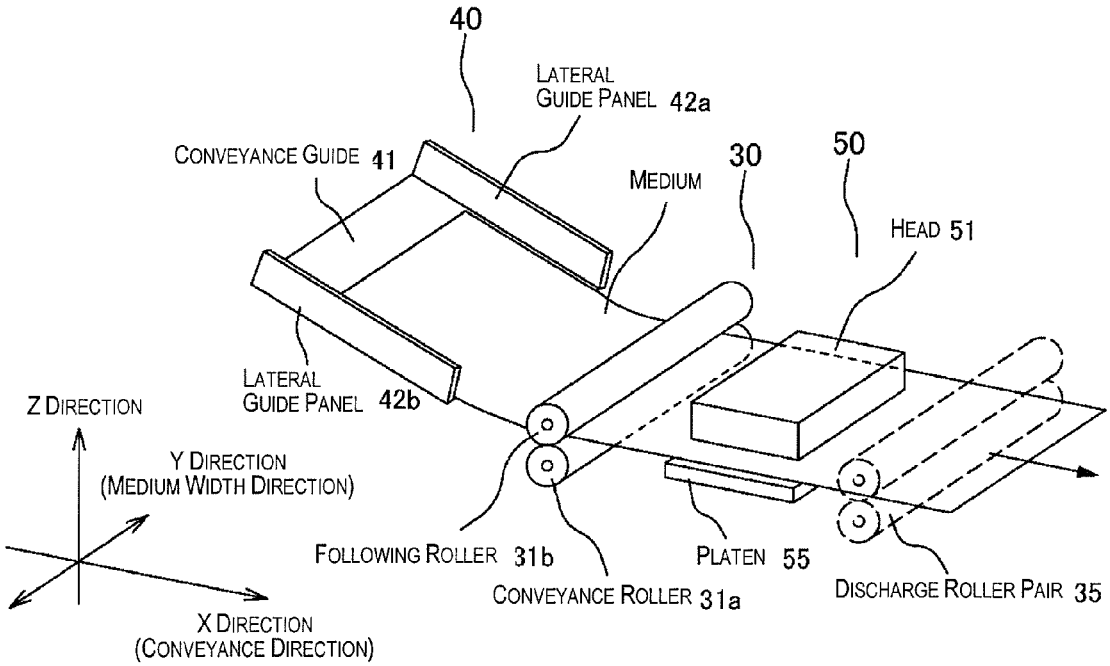
FIGS. 1A and 1B are schematic views showing the configuration of the printer according to the present embodiment.

The aspects described below, at least, will become clearer through the description of the present specification and the accompanying drawings. Clarified is a printing device including a conveyance roller for conveying a medium in a conveyance direction; a guide for supporting the medium on a top surface of the guide on an upstream side in the conveyance direction from the conveyance roller; and a head for ejecting ink and printing on the medium on a downstream side in the conveyance direction from the conveyance roller; the top surface of the guide is positioned higher than a line tangent to the conveyance roller at a position of contact between the conveyance roller and the medium; and an end part of the guide on the downstream side in the conveyance direction has a smaller thickness in the direction in which the medium is supported than on the upstream side of the end part in the conveyance direction. Through the printing device thus configured, conveyance defects due to kicking can be prevented.

Preferably, in the printing device, a corner of the guide on one side in the direction in which the medium is supported at an end part of a downstream side of the guide in the conveyance direction is beveled at an angle with respect to the direction in which the medium is supported. Through the printing device thus configured, kicking can be made less prone to occur.

Preferably, in the printing device, the medium having been printed on one side by the head is conveyed backward by the conveyance roller so as to pass under the guide, whereby the one side is reversed so as to be supported on a top surface of the guide, and printing is performed on both sides of the medium. Through the printing device thus configured, conveyance precision can be prevented from decreasing during double-sided printing as well.

Preferably, in the printing device, a region of the guide for supporting the medium narrows toward a downstream side in the conveyance direction. Through the printing device thus configured, the medium can be kept from vibrating when leaving the guide.

Also clarified is a printing method including the steps of conveying a medium in a conveyance direction through use of a conveyance roller; supporting the medium through use of a guide, wherein the guide supports the medium on a top surface of the guide on an upstream side in the conveyance direction from the conveyance roller, the top surface of the guide is positioned higher than a line tangent to the conveyance roller at a position of contact between the conveyance roller and the medium, and an end part of the guide on the downstream side in the conveyance direction has a smaller thickness in the direction in which the medium is supported than on the upstream side of the end part in the conveyance direction; and ejecting ink to the medium from a head provided on a downstream side in the conveyance direction from the conveyance roller.

Basic Configuration of the Printing Device

The printer 10 as the printing device used in the present embodiment and the drive method of the printer 10 will be described. The printer 10 of the present embodiment is a printing device provided with a conveyance mechanism capable of conveying paper, a thin plate, or another conveyed medium in a predetermined direction (also referred to hereinafter as the conveyance direction). The printer 10 is an inkjet-type printer, and the inkjet-type printer may be a device employing any ejection method insofar as the inkjet-type printer is a device capable of printing by ejecting ink. In the present specification, the conveyance direction is described as the X direction, the direction (also referred to as the medium width direction) orthogonal to the conveyance direction is described as the Y direction, and the upward perpendicular direction is described as the Z direction.

<Configuration of the Printer 10>

Figure 1B:
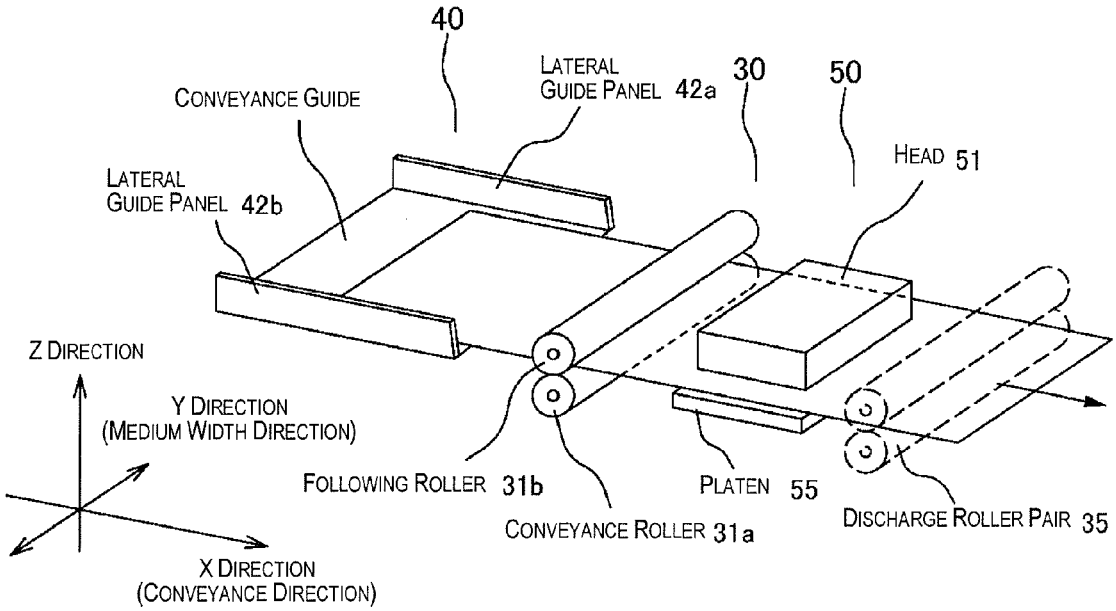
Figure 2:
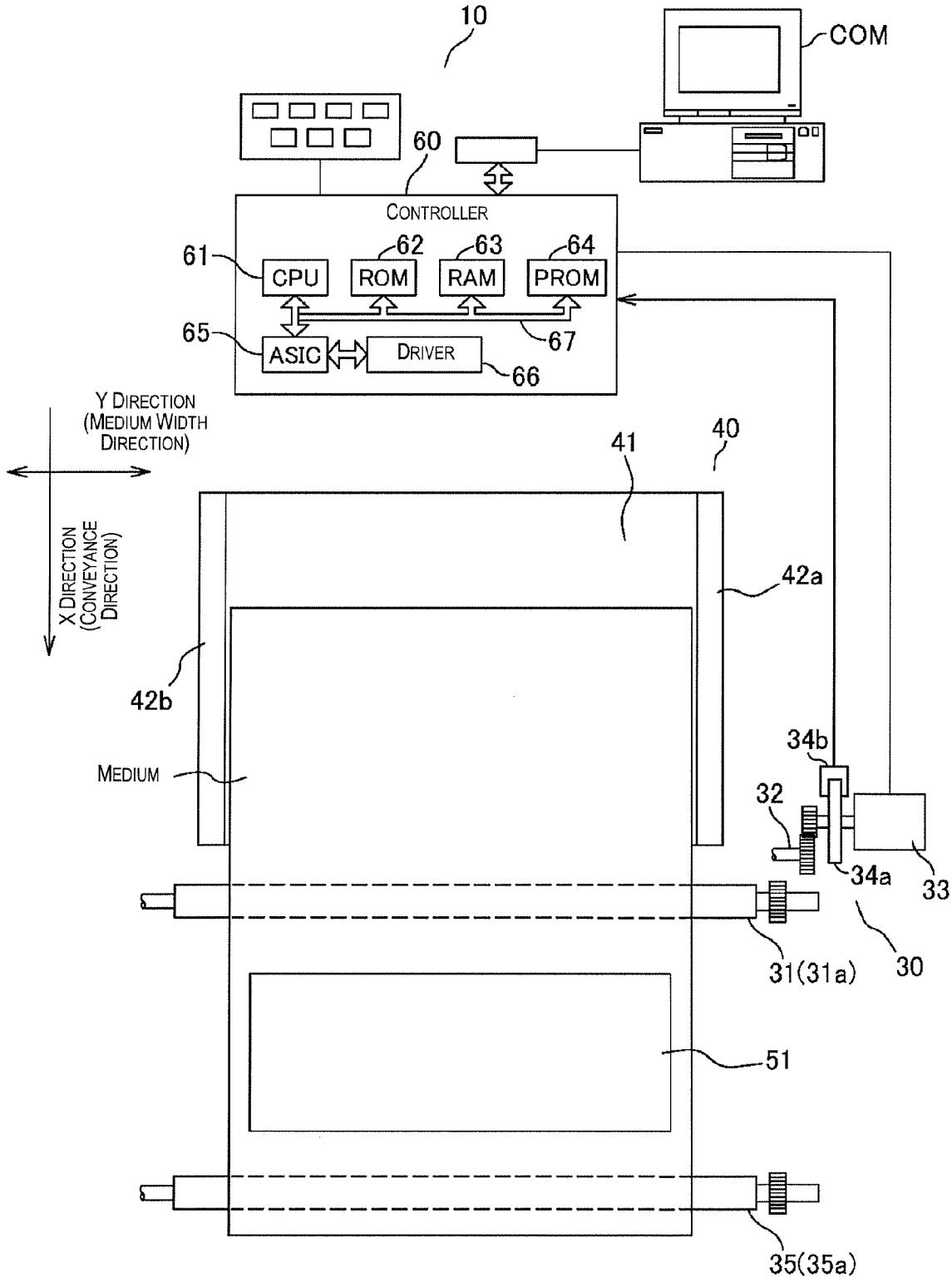
FIG. 2 is a view showing the relationship between the control system and the drive system which uses a DC motor in the printer.

FIGS. 1A and 1B are schematic views showing the configuration of the printer 10 according to the present embodiment. FIG. 2 is a view showing the relationship between the control system and the drive system which uses a DC motor in the printer 10.

The printer 10 has a medium conveyance mechanism 30, a medium support mechanism 40, a printing mechanism 50, and a controller 60.

The medium conveyance mechanism 30 conveys a medium in the conveyance direction. The medium conveyance mechanism 30 has a conveyance roller pair 31, a gear wheel train 32, a PF motor 33, and a rotation detector 34.

The conveyance roller pair 31 is equipped with a conveyance roller 31*a* and a following roller 31*b* which are capable of holding the conveyed medium (e.g., paper P) therebetween.

The PF motor 33 provides drive force (rotational force) to the conveyance roller 31*a* via the gear wheel train 32 (FIG. 2). The rotation direction of the PF motor 33 can be freely modified. In the following description, the direction of rotation of the PF motor 33 when the medium is moved forward in the conveyance direction is referred to as the positive rotation direction, and the opposite direction is referred to as the negative rotation direction. In the printer 10 of the present embodiment, by rotating the PF motor 33 in the negative rotation direction, the medium can be conveyed in the direction opposite to the conveyance direction, and adaptation can be made to double-sided printing and various other printing methods. The drive part for driving the conveyance roller 31*a* is not limited to a "motor" such as the PF motor 33, and hydraulically operated actuator or the like may also be used.

The rotation detector 34 detects the rotation amount of the PF motor 33 or the conveyance roller 31*a*. The conveyance amount of the medium can thereby be monitored/controlled. A rotary encoder is used as the rotation detector 34 in the present embodiment. The rotation detector 34 is therefore equipped with a disk-shaped scale 34*a* and a rotary sensor 34*b*. The disk-shaped scale 34*a* has transparent parts for transmitting light and opaque parts for blocking the transmission of light at fixed intervals in the circumferential direction thereof. The primary constituent elements of the rotary sensor 34*b* are a light-emitting element not shown in the drawing, a light-receiving element also not shown in the drawing, and a signal processing circuit also not shown in the drawing.

A plurality of roller pairs the same as the conveyance roller pair 31 may be provided as the medium conveyance mechanism 30. For example, as shown in FIGS. 1A and 1B, a discharge roller pair 35 for discharging the printed medium to the outside of the printer 10 may be provided on the downstream side in the conveyance direction from the conveyance roller pair 31 and the printing mechanism 50. The discharge roller pair 35 has the same configuration as the conveyance roller pair 31 and discharges the medium by rotating in conjunction with the rotation of the conveyance roller 31*a*. The discharge roller pair 35 also has a motor as the drive part, a gear wheel train for transmitting drive force, and a rotation detector (none of which are shown in the drawing).

The medium support mechanism 40 supports the conveyed medium and adjusts the width-direction (Y direction) position of the medium during conveyance on the upstream side in the conveyance direction of the medium conveyance mechanism 30. The medium support mechanism 40 has a conveyance guide 41 (corresponding to the guide) and lateral guide panels 42.

The conveyance guide 41 is a plate-shaped member for supporting the conveyed medium from below. The shape of the guide will be described in detail hereinafter. The lateral guide panels 42 are composed of lateral guide panels 42*a* and 42*b* provided at both ends of the conveyance guide 41 in the Y direction (medium width direction), and fix the position of the medium in the width direction and guide the medium so that the medium is correctly moved forward on the conveyance path. The position of the lateral guide panels 42 in the Y direction can be adjusted in accordance with the size (width) of the conveyed medium. To accomplish this adjustment, the guide panels 42*a* and 42*b* may both be configured so as to able to move both ways in the Y direction, or the Y-direction position of one panel (e.g., the lateral guide panel 42*a*) may be fixed so that the Y-direction position of only one panel (e.g., the lateral guide panel 42*b*) can be moved.

The medium support mechanism 40 is disposed in a position higher in the Z direction than the installation position of the conveyance roller 31*a*, and at an angle with respect to the X direction, as shown in FIG. 1A. The medium can thereby be smoothly fed to the position of the conveyance roller 31*a* at an angle from above. Alternatively, a configuration may be adopted in which the installation angle is modified so that the medium support mechanism 40 is parallel to the X direction, and the medium can be fed to the conveyance roller 31*a* directly from the side, as shown in FIG. 1B.

The printing mechanism 50 forms an image by ejecting ink to the conveyed medium in a region between the conveyance roller pair 31 and the discharge roller pair 35. The printing mechanism 50 has a head 51 and a platen 55.

The head 51 ejects ink to the medium from above the medium in the Z direction and forms an image by landing numerous ink droplets on the medium. A nozzle row (not shown in the drawing) corresponding to each ink is provided on a lower surface of the head 51, and a piezo element is disposed in each of a plurality of nozzles constituting each nozzle row. When ink is fed to a nozzle via an ink passage from an ink tank not shown in the drawing, an ink droplet can be ejected from the nozzle at the end of the ink passage by the operation of the piezo element. The head 51 is also not limited to operation by a piezo drive scheme using piezo elements, and may employ a heater scheme in which the ink is heated by a heater to utilize the force of a resultant bubble, a magneto-striction scheme using a magneto-striction element, a mist scheme for controlling a mist by an electric field, or another scheme. The ink used for printing may be dye-based ink, pigment-based ink, or any other type of ink.

The platen 55 is installed in a position facing the head 51 on the other side of the medium (see FIG. 1), and supports the medium from below during printing. By providing suction holes to the surface of the head 51 and suctioning air, the medium can be suction-retained during printing.

The controller 60 controls the rotation speed and rotation direction of the conveyance roller 31*a* and a paper output roller 35*a* to cause the paper to be conveyed. As shown in FIG. 2, the controller 60 is equipped with a CPU 61, a ROM 62, a RAM 63, a PROM 64, an ASIC 65, a motor driver 66, and other components, and these components are connected to each other via a bus or other transmission channel 67. The controller 60 is also connected to a computer COM. The PF motor 33 and other components are controlled by these hardware components, cooperation of software and/or data stored in the ROM 62 or the PROM 64, or the addition of a circuit or constituent element for performing specialized processing.

Positional Relationship Between the Conveyance Guide Conveyance Roller

In a printing device such as described above, the line tangent to the conveyance roller 31*a* at the position of contact between the conveyance roller 31*a* and the medium is usually lower than the conveyance surface of the conveyance guide 41. In other words, the conveyance surface of the conveyance guide 41 is positioned higher than a line tangent to the conveyance roller 31*a* at the position of contact between the conveyance roller 31*a* and the medium. The reasons for increasing the elevation of the conveyance surface of the conveyance guide 41 are described below.

In the case of double-sided printing, for example, the position of the conveyance guide 41 is set as shown in FIG. 1A, the medium having been printed on one side is conveyed backward so as to pass under the conveyance guide 41, and the front and back of the medium are reversed by a reversing mechanism not shown in the drawing. The top surface (conveyance surface) of the conveyance guide 41 must therefore be positioned higher than the tangent line at the position of contact between the conveyance roller 31*a* and the medium so that the medium reliably passes under the conveyance guide 41 when being conveyed backward.

The conveyance roller 31*a* is formed using a material (rubber or the like) having a large frictional coefficient in order to control the conveyance amount. In contrast, a material having a smaller frictional coefficient than the conveyance roller 31*a* is used in the following roller 31*b*. The paper P is thus led between the conveyance roller 31*a* and the following roller 31*b* more easily when the distal end of the medium contacts the lower part of the following roller 31*b* than when the distal end of the medium contacts the upper part of the conveyance roller 31*a* in a case in which the medium support mechanism 40 is parallel to the X direction, as shown in FIG. 1B. In short, a state is easily achieved in which the paper P is held between the conveyance roller 31*a* and the following roller 31*b*. The conveyance surface of the conveyance guide 41 is thus provided at a position higher than the position of contact between the conveyance roller 31*a* and the medium so that the medium makes contact with the following roller 31*b* even in a case such as the one shown in FIG. 1B. There is also a gap between the conveyance roller pair 31 and the end part of the conveyance guide 41 on the downstream side thereof in the X direction. The distal end of the paper P leaving the conveyance guide 41 therefore sometimes sags downward in the perpendicular direction due to the weight thereof. Therefore, by elevating the position of the conveyance guide 41, the paper P is easily held between the conveyance roller pair 31 (conveyance roller 31*a*, following roller 31*b*) even when the paper P sags under the weight thereof.

Furthermore, error during attachment of the conveyance guide 41 sometimes causes the conveyance surface of the conveyance guide 41 to be higher than the position of contact between the conveyance roller 31*a* and the medium.

For such reasons as those described above, the conveyance surface of the conveyance guide 41 is positioned higher than the tangent line at the position of contact between the conveyance roller 31*a* and the medium. However, when the conveyance surface of the conveyance guide 41 is in such an elevated position, there is a risk of the conveyance defect referred to as kicking when the medium leaves the end part of the conveyance guide 41 on the downstream side in the conveyance direction. Kicking is a phenomenon in which a pushing force between the guide and the medium acts to push the medium out in the conveyance direction at the moment the trailing end (upstream end in the conveyance direction) of the medium leaves the guide.

Comparative Example

Medium conveyance in the conveyance guide 41 of a Comparative Example during printing will first be described. FIGS. 3A through 3D are views showing medium conveyance over time in a comparative example. In FIGS. 3A through 3D, the area near the conveyance guide 41 is viewed from the Y direction (medium width direction) in the configuration shown in FIG. 1B (where the conveyance guide 41 is parallel to the X direction). The lateral guide panels 42*a* and 42*b* are not shown in FIGS. 3A through 3D. As shown in FIGS. 3A through 3D, the conveyance guide 41 of the comparative example is a plate-shaped member having a predetermined thickness (length in the Z direction), and the thickness is constant at all positions in the X direction. As described above, the medium conveyance surface (top surface) of the conveyance guide 41 is positioned higher than the tangent line at the position of contact between the conveyance roller 31*a* and the medium.

Figure 3A:
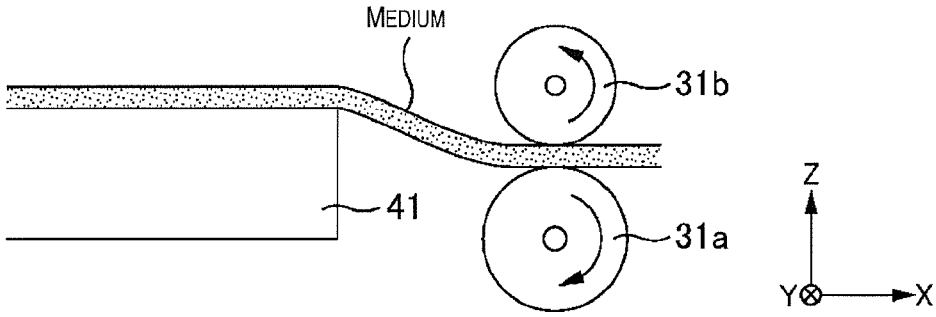
FIGS. 3A through 3D are views showing the medium conveyance over time in a comparative example.

As shown in FIG. 3A, the medium is supported by the conveyance guide 41 and conveyed in the conveyance direction (X direction) while being held between the conveyance roller 31*a* and the following roller 31*b*. At this time, a force which pushes the conveyance guide 41 acts on the medium, and a frictional force in the opposing direction from the conveyance direction occurs with respect to the medium being conveyed. This frictional force acts via the medium to inhibit the positive rotation of the conveyance roller 31*a*. In other words, during conveyance of the medium, a force directed oppositely from the conveyance direction acts on the conveyance roller 31*a*, due to friction. In cases in which the medium is thick or rigid, for example, since the force of resistance to sagging is large, the frictional force is also large, and a large force also acts on the conveyance roller 31*a*. In the X-Z plane of FIG. 3A at this time, the medium is supported in a state such as that of a doubly supported beam by both the conveyance guide 41 and the conveyance roller 31*a*.

Figure 3B:
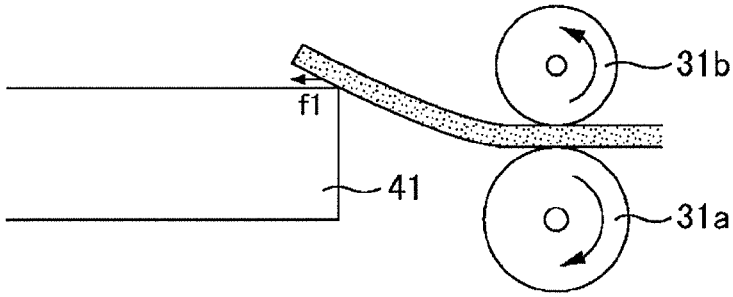
Figure 3C:
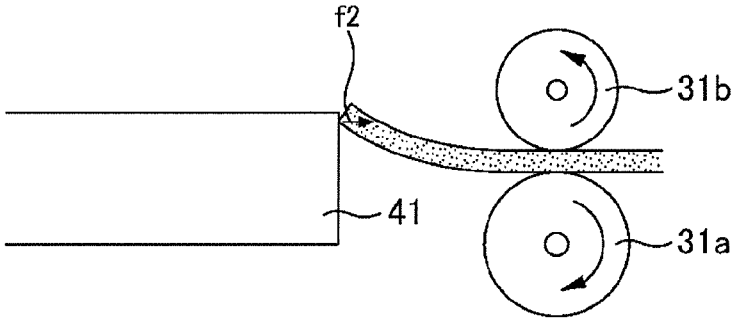
Figure 3D:
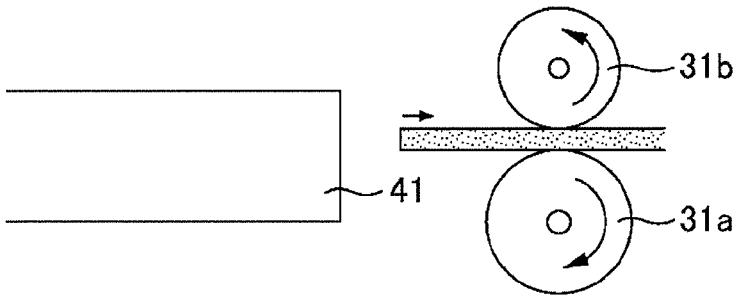

As conveyance of the medium progresses, the trailing end portion (end part on the upstream side in the X direction) of the medium sags, and is supported by a corner of the conveyance guide 41 on the downstream side thereof in the conveyance direction, as shown in FIG. 3B. A frictional force f1 acts between the medium and the conveyance guide 41. As conveyance progresses further, the trailing end part of the medium leaves the top surface of the conveyance guide 41 and makes contact with an end surface of the conveyance guide 41 on the downstream side thereof in the X direction, as shown in FIG. 3C. At this time, a force acts on the medium to return the sag to the original state, and the conveyance guide 41 is pushed upstream in the X direction. The medium thereby receives a pushing force f2 directed downstream in the X direction from the conveyance guide 41. When the medium leaves the conveyance guide 41, since the pushing force f2 acts to push out the medium in the X direction, the medium is conveyed further (kicked) in the X direction than the target conveyance amount. The medium then leaves the conveyance guide 41 as shown in FIG. 3D, and the medium is supported in a state such as that of a cantilever beam by the conveyance roller 31*a*.

In this comparative example, kicking causes an error to occur in the conveyance amount, and there is a risk of reduced printing quality. Therefore, in the embodiment described below, kicking is reduced and conveyance defects are suppressed by improving the shape of the conveyance guide 41. A reduction in printing quality can thereby be prevented.

First Embodiment

Figure 4A:
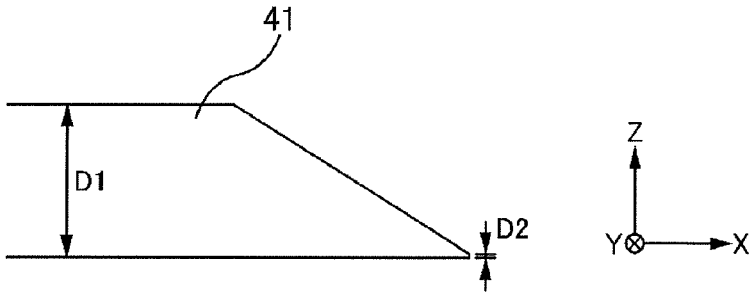
FIG. 4A is a transverse sectional view showing the conveyance guide of the first embodiment.
Figure 4B:
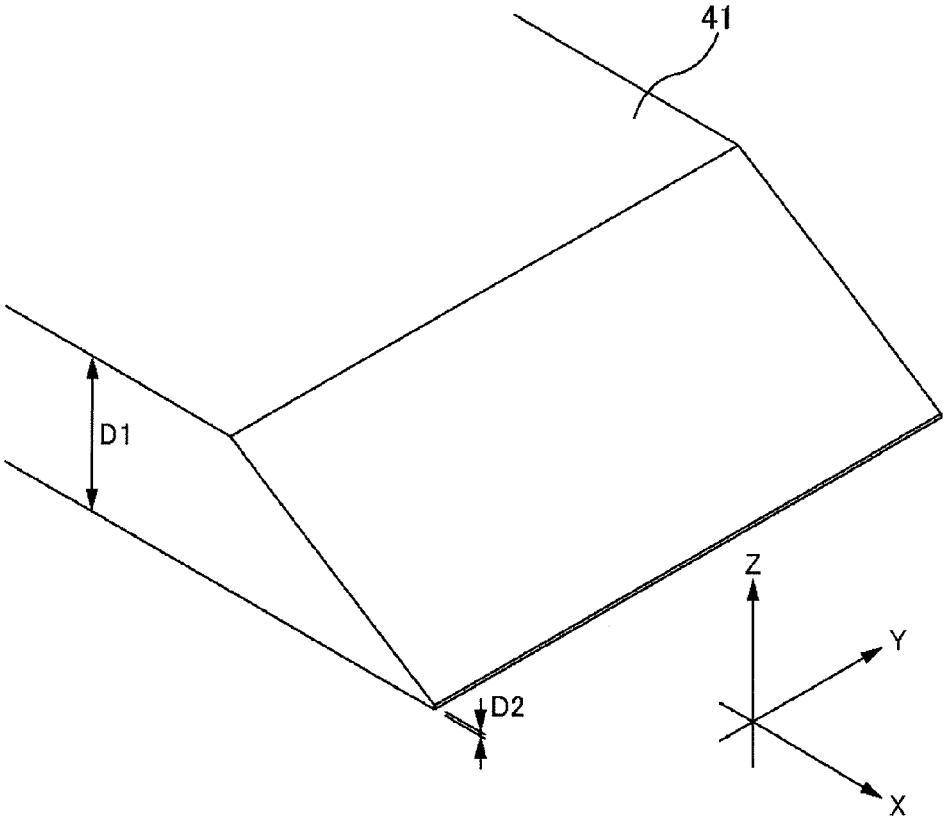
FIG. 4B is a perspective view showing the conveyance guide of the first embodiment.

FIG. 4A is a transverse sectional view showing the conveyance guide 41 of the first embodiment, and FIG. 4B is a perspective view showing the conveyance guide 41 of the first embodiment. FIGS. 4A and 4B show the shape of the conveyance guide 41 on the downstream side thereof in the X direction (i.e., the side near the conveyance roller 31*a*). The lateral guides 42*a*, 42*b* are not shown in FIGS. 4A and 4B. As shown in FIGS. 4A and 4B, the thickness of the conveyance guide 41 of the present embodiment in the direction in which the paper is supported (the Z direction in this case) is not constant, and the thickness in the Z direction decreases at the downstream end in the X direction (conveyance direction). Specifically, an inclined surface is provided in which the corner on the Z-direction downstream side (side facing upward in the perpendicular direction) is beveled so that the thickness gradually decreases toward the downstream side in the X direction with respect to the conveyance guide 41 having a thickness D1 in the Z direction. The thickness in the Z direction of the X-direction downstream end of the conveyance guide 41 is thereby D2 (<D1). In other words, in the conveyance guide 41 of the present embodiment, the thickness of the X-direction downstream end is extremely small compared with the thickness of the upstream portion.

FIGS. 5A through 5D are views showing the medium conveyance over time in the present embodiment. In FIGS. 5A through 5D, the area near the conveyance guide 41 is viewed from the Y direction (medium width direction) in the configuration shown in FIG. 1B. As described above, the medium conveyance surface of the conveyance guide 41 is positioned higher than the tangent line at the position of contact between the conveyance roller 31*a* and the medium.

Figure 5A:
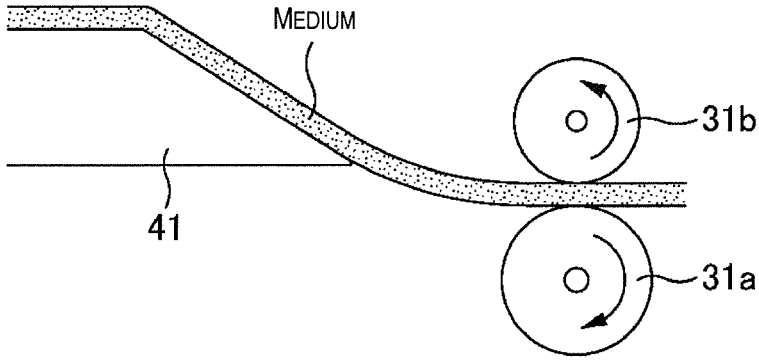
FIGS. 5A through 5D are views showing the medium conveyance over time in the present embodiment.

As shown in FIG. 5A, the medium is supported by the conveyance guide 41 and conveyed in the conveyance direction (X direction) while being held between the conveyance roller 31*a* and the following roller 31*b*. At this time, a force which pushes the conveyance guide 41 acts on the medium, the same as in the comparative example (FIG. 3A), and a frictional force in the opposing direction from the conveyance direction occurs with respect to the medium being conveyed. In the X-Z plane of FIG. 3A at this time, the medium is supported in a state such as that of a doubly supported beam by both the conveyance guide 41 and the conveyance roller 31*a*.

Figure 5B:
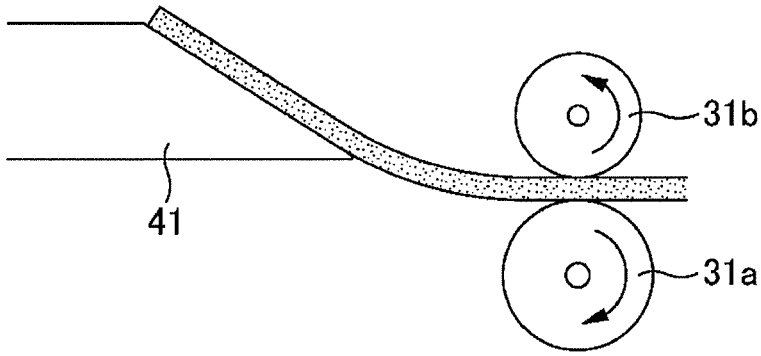
Figure 5C:
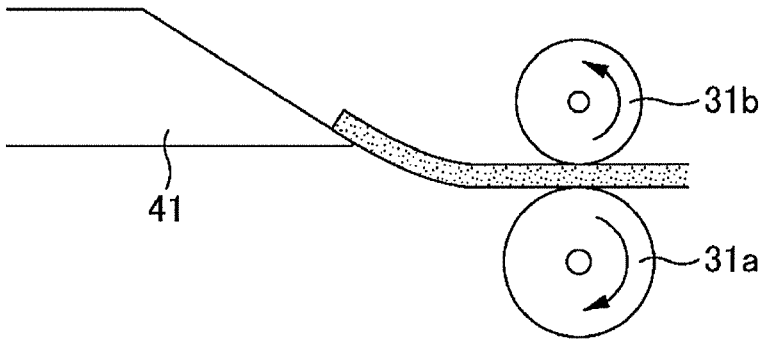
Figure 5D:
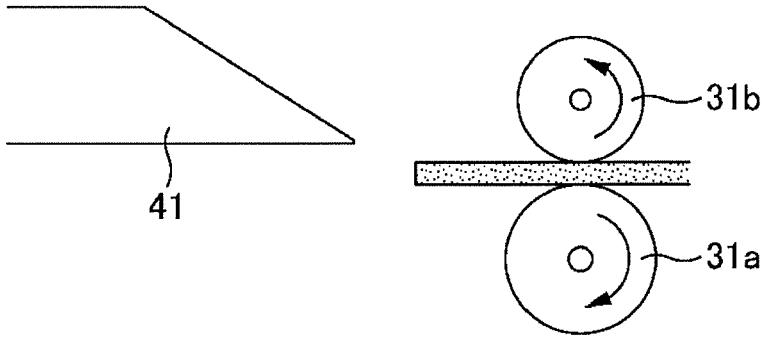

As conveyance of the medium progresses, the trailing end portion (end part on the upstream side in the X direction) of the medium is supported by the inclined surface of the conveyance guide 41, as shown in FIG. 5B. The trailing end portion of the medium is conveyed along the inclined surface while being supported by the inclined surface. As conveyance progresses further, the trailing end part of the medium leaves the inclined surface of the conveyance guide 41 as shown in FIG. 5C. At this time, since the thickness in the Z direction of the X-direction downstream end of the conveyance guide 41 in the is extremely small (D2), the medium and the X-direction downstream end of the conveyance guide 41 do not readily make contact. In other words, relative to the comparative example, the conveyance guide 41 is not readily subjected to a force opposing the sagging of the medium, and the medium is not readily subjected to a pushing force directed downstream in the X direction from the conveyance guide 41. Kicking can thereby be suppressed. As is apparent from the drawings, the thickness of the X-direction downstream end of the conveyance guide 41 is preferably as small as possible to suppress kicking. The medium then leaves the conveyance guide 41 as shown in FIG. 5D, and the medium is supported in a state such as that of a cantilever beam by the conveyance roller 31*a*.

The thickness of the X-direction downstream end of the conveyance guide 41 is thus reduced in comparison with that of the upstream side in the present embodiment. Kicking is thereby made less prone to occur when the medium leaves the conveyance guide 41. Conveyance defects can thereby be suppressed, and a reduction in printing quality can be prevented.

MODIFICATIONS

Figure 6A:
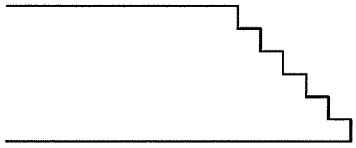
FIGS. 6A through 6C are schematic views showing modifications of the first embodiment.
Figure 6B:
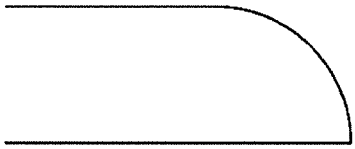
Figure 6C:
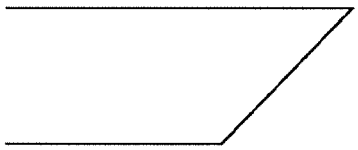
Figure 6C:
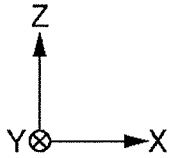

In the embodiment described above, the corner portion of the top side (Z-direction downstream side) in the downstream end in the X-direction of the conveyance guide 41 is beveled in linear fashion, but this configuration is not limiting. FIGS. 6A through 6C are schematic views showing modifications of the first embodiment. FIGS. 6A through 6C are sectional views in the X-Z plane of the conveyance guide 41.

In FIG. 6A, the top side (Z-direction downstream side) of the X-direction downstream end of the conveyance guide 41 is formed in a staircase shape, and the thickness decreases in stepped fashion. In this case as well, the conveyance guide 41 is not readily subjected to a force opposing the sagging of the medium when the medium leaves the conveyance guide 41, the same as in the embodiment described above. The medium is thus not readily subjected to a pushing force from the conveyance guide 41. Kicking can thereby be suppressed. In FIG. 6B, the top side of the X-direction downstream end of the conveyance guide 41 is shaped so as to have a curved bevel rather than a linear bevel. In FIG. 6C, the bottom side (Z-direction upstream side) of the X-direction downstream end is beveled in linear fashion. In these cases as well, kicking can be suppressed by reducing the thickness of the X-direction downstream end of the conveyance guide 41. Shapes other than those described above may also be used. In other words, the downstream end in the X direction of the conveyance guide 41 may have any shape insofar as the thickness thereof is reduced.

The conveyance guide 41 in the configuration shown in FIG. 1B is described in the embodiment above, but the present invention can be applied in the same manner in the case that the conveyance guide 41 is disposed as shown in FIG. 1A. The top surface of the conveyance guide 41 is also higher than the tangent line at the position of contact between the conveyance roller 31*a* and the medium in the configuration shown in FIG. 1A. In this case as well, there is a risk of kicking when the medium leaves the conveyance guide 41. As in the embodiment described above, by reducing the thickness of the X-direction downstream end of the conveyance guide 41, kicking can be prevented when the medium leaves the conveyance guide 41. A reduction in conveyance precision can thereby be prevented, and reduction in printing quality can be prevented.

Second Embodiment

In the case of the first embodiment, when the medium leaves the conveyance guide, there is a risk of a situation occurring in which the medium supported in a state such as that of a doubly supported beam by the conveyance guide 41 and the conveyance roller 31*a* suddenly loses the support of the conveyance guide 41 and is placed in a state such as that of a cantilever beam, and the trailing end part of the medium vibrates. This effect can make it impossible to correctly convey the medium, and a conveyance defect can occur. The second embodiment is therefore configured so that abrupt changes are kept to a minimum when the medium leaves the conveyance guide 41. Specifically, a configuration is adopted in which the width of the conveyance guide 41 in the Y direction thereof (medium width direction) gradually decreases at the downstream end in the X direction (conveyance direction).

Figure 7A:
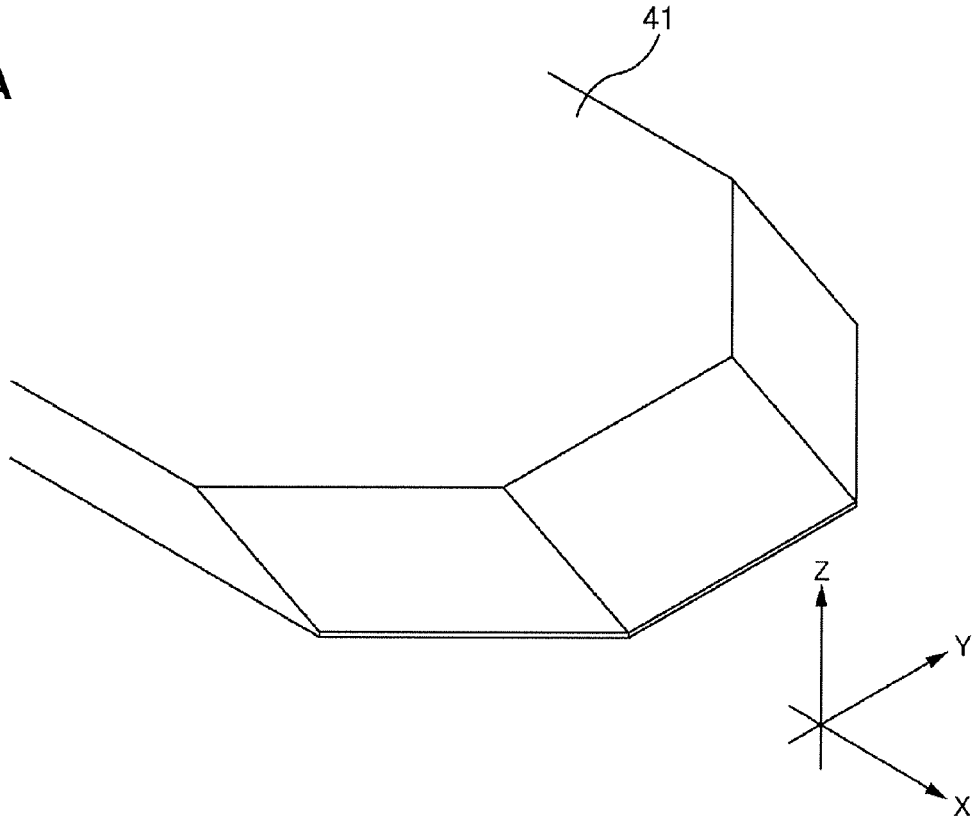
FIG. 7A is a perspective view showing the conveyance guide of a second embodiment.
Figure 7B:
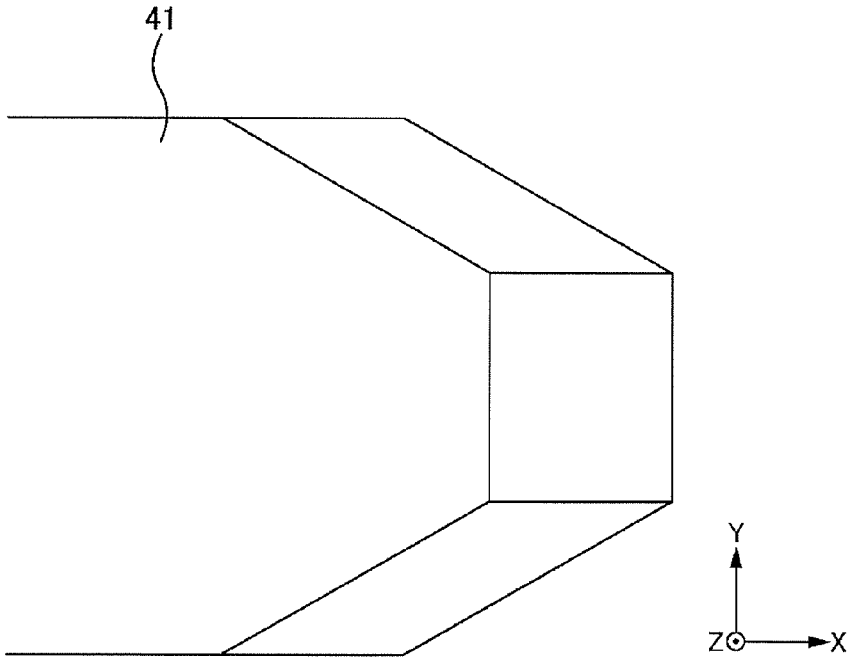
FIG. 7B is a view showing the conveyance guide of the second embodiment from above.

FIG. 7A is a perspective view showing the conveyance guide 41 of the second embodiment, and FIG. 7B is a view (XY plan view) showing the conveyance guide 41 of the second embodiment from above (from the Z-direction downstream side). As shown in FIGS. 7A and 7B, the conveyance guide 41 of the second embodiment is shaped such that both corner portions in the Y direction at the downstream side in the X direction are cut away at an angle from a rectangular flat plate, the region supporting the medium being narrowest at the center in the Y direction at the side farthest downstream in the X direction. The thickness of the downstream end of the conveyance guide 41 in the conveyance direction is reduced in the second embodiment, the same as in the embodiment described above.

In the conveyance guide 41 of the second embodiment, the surface area of contact with the medium gradually decreases as the trailing end of the medium is conveyed. Therefore, vibration of the trailing end part of the medium due to sudden movement of the medium away from the conveyance guide 41 can be better prevented than in a case in which the corner portions in the Y direction are not cut away at an angle. Since the thickness of the X-direction downstream end of the conveyance guide is also reduced, the occurrence of kicking can be suppressed when the medium leaves the conveyance guide 41. Conveyance defects can thereby be further suppressed in the second embodiment.

Other Embodiments

A printing device is described as an embodiment above, but the embodiments described above are merely for facilitating understanding of the present invention and are not to be interpreted as limiting the present invention. The present invention may be modified and improved within the intended scope thereof, and equivalents to the present invention are included in the scope of the present invention. The embodiment described below in particular is included in the present invention.

Medium

The medium is described as paper or the like in the above embodiments, but a medium other than paper may also be used insofar as the medium is in a sheet shape which can be conveyed by the conveyance roller 31*a*. For example, a film-shaped member, a resin sheet, aluminum foil, or the like can be used as the medium.

Controller

The controller 60 is not limited to the embodiment described above, and may be configured so as to administer control of the PF motor 33 solely through use of the ASIC 65, for example. The controller 60 may also be configured as a combination of a single-chip microcomputer or the like in which various other peripheral devices are integrated.

What is claimed is:

1. A printing device comprising:

a conveyance roller configured to convey a medium in a conveyance direction;

a guide configured to support the medium, the guide being disposed at an upstream side in the conveyance direction from the conveyance roller, the guide having a first surface and a second surface, the first surface facing and supporting the medium thereon, the second surface being opposed to the first surface in a direction in which the first surface supports the medium, the guide further having a first portion and a second portion, the first portion being formed of the first surface and the second surface that extend parallel with respect to each other in the conveyance direction and have a first thickness therebetween in the direction in which the first surface supports the medium, the second portion being disposed at a downstream end of the guide in the conveyance direction and formed of the first surface and the second surface that have a second thickness in the direction in which the first surface supports the medium, the second thickness being smaller than the first thickness; and a head configured to eject ink and print on the medium at a downstream side in the conveyance direction from the conveyance roller;

the first surface of the guide being positioned higher than a line tangent to the conveyance roller at a position of contact between the conveyance roller and the medium.

2. The printing device according to claim 1, wherein a corner of the guide on one side in the direction in which the first surface supports the medium at the downstream end of the guide in the conveyance direction is beveled at an angle with respect to the direction in which the first surface supports the medium.

3. The printing device according to claim 1, wherein the medium having been printed on a printing surface side by the head is conveyed backward by the conveyance roller so as to pass under the guide, whereby the printing surface side is reversed so as to be supported on a top surface of the guide, and printing is performed on both sides of the medium.

4. The printing device according to claim 1, the second portion of the guide for supporting the medium narrows toward the downstream side in the conveyance direction.

5. The printing device according to claim 1, wherein the head ejects the ink and prints on a printing surface side of the medium, and the first surface of the guide is arranged to contact an opposite surface side of the medium that is opposite to the printing surface side of the medium.

6. The printing device according to claim 5, wherein the first surface of the guide is arranged farther apart from the line than the second surface of the guide in a direction that the printing surface side of the medium faces toward.

7. The printing device according to claim 1, wherein the guide is positioned stationarily with respect to the conveyance roller.

8. A printing method comprising the steps of:

conveying a medium in a conveyance direction through use of a conveyance roller;

supporting the medium through use of a guide, the guide being disposed at an upstream side in the conveyance direction from the conveyance roller, the guide having a first surface and a second surface, the first surface facing and supporting the medium thereon, the second surface being opposed to the first surface in a direction in which the first surface supports the medium, the first surface of the guide being positioned higher than a line tangent to the conveyance roller at a position of contact between the conveyance roller and the medium, the guide further having a first portion and a second portion, the first portion being formed of the first surface and the second surface that extend parallel with respect to each other in the conveyance direction and have a first thickness therebetween in the direction in which the first surface supports the medium, the second portion being disposed at an downstream end of the guide in the conveyance direction and formed of the first surface and the second surface that have a second thickness in the direction in which the first surface supports the medium, the second thickness being smaller than the first thickness; and ejecting ink to the medium from a head provided at the downstream side in the conveyance direction from the conveyance roller.

9. The printing method according to claim 8, wherein the head ejects the ink and prints on a printing surface side of the medium, and the first surface of the guide is arranged to contact an opposite surface side of the medium that is opposite to the printing surface side of the medium.

10. The printing method according to claim 9, wherein the first surface of the guide is arranged farther apart from the line than the second surface of the guide in a direction that the printing surface side of the medium faces toward.

11. The printing method according to claim 8, wherein the guide is positioned stationarily with respect to the conveyance roller.

* * * * *